United States Patent [19]

Achard et al.

[11] 4,256,684

[45] Mar. 17, 1981

[54] HIGH-SHRINKAGE ACRYLIC FIBERS AND THE PROCESS FOR THEIR PRODUCTION

[75] Inventors: Georges Achard, Decines; Gilbert Anouilh, Lyons; Pierre Chion, Bron; Roger Vincent, Colmar, all of France

[73] Assignee: Rhone-Poulenc Textile, Paris, France

[21] Appl. No.: 44,690

[22] Filed: Jun. 1, 1979

[30] Foreign Application Priority Data

Jun. 5, 1978 [FR] France ..... 78 16979
Apr. 10, 1979 [FR] France ..... 79 09256

[51] Int. Cl.[3] ..... D01D 5/22

[52] U.S. Cl. ..... 264/168; 264/182; 264/210.3; 264/210.7; 264/210.8

[58] Field of Search ..... 264/210.7, 168, 182, 264/210.8, 210.3

[56] References Cited

U.S. PATENT DOCUMENTS

| | | | |
|---|---|---|---|
| 3,097,054 | 7/1963 | Roustson et al. | 264/182 |
| 3,097,055 | 7/1963 | Roustson et al. | 264/182 |
| 3,404,204 | 10/1968 | Nakagawa et al. | 264/182 |
| 3,523,150 | 8/1970 | Vignault | 264/210.7 |
| 3,558,761 | 1/1971 | Tabara et al. | 264/210.7 |
| 3,963,790 | 6/1976 | Couchon | 264/182 |
| 4,067,948 | 1/1978 | Reinher et al. | 264/182 |

FOREIGN PATENT DOCUMENTS

| | | | |
|---|---|---|---|
| 39-22043 | 10/1964 | Japan | 264/182 |
| 42-4293 | 2/1967 | Japan | 264/182 |
| 42-22589 | 11/1967 | Japan | 264/182 |
| 44-7759 | 4/1969 | Japan | 264/182 |
| 49-25228 | 3/1974 | Japan | 264/182 |

*Primary Examiner*—Jay H. Woo
*Attorney, Agent, or Firm*—Stevens, Davis, Miller & Mosher

[57] ABSTRACT

Acrylic yarns and fibers having a high shrinkage power, ranging up to 50%, obtained by wet spinning, a stretching of 1.3 to 3 × in air, washing, a stretching of 1 to 2.5 × into boiling water, drying, steaming at 105°–150° C., over-stretching of 1.2 to 2 × at 90°–100° C.

5 Claims, No Drawings

HIGH-SHRINKAGE ACRYLIC FIBERS AND THE PROCESS FOR THEIR PRODUCTION

The present invention relates to acrylic yarns and fibers having a high latent shrinkage which may range up to about 50% and is generally between 20 and 50% in boiling water, and preferably at least 30%.

The present invention also relates to a process for the production of such fibers.

Yarns and fibers having a high latent shrinkage are of great value because, when mixed in varying proportions with other yarns or fibers which can shrink only slightly, if at all, they make it possible to obtain bulky spun yarns which possess a certain elasticity, if necessary after subsequent treatments such as heat treatment, additional stretching and the like.

It is already known from French application No. 2,318,251, published on Feb. 2, 1977, to prepare fibers or yarns having a shrinkage greater than 30%, and preferably greater than 35%, by wet-steam fixation of the acrylic filaments, for at least one minute, and stretching in a ratio of 3.5 to 5×, followed by drying at low temperature.

However, the position of the drying operation at the end of the process makes it necessary to treat highly swollen fibers throughout the process, and this makes this process difficult to carry out and results in fibers with non-uniform shrinkage characteristics. Furthermore, the low drying temperature makes this process rather uneconomical.

There have now been found (in accordance with the present invention) acrylic yarns and fibers having a high latent shrinkage which can range up to 50% in boiling water, which yarns and fibers are obtained by the steps comprising wet-spinning at least one solution of acrylic polymer, stretching the resulting filaments in air, at ambient temperature, in a ratio between 1.3 and 3×, washing with water, further stretching in boiling water in a ratio between 1 and 2.5×, sizing, drying at a temperature between 80° and 140° C., steam treating at a temperature between 105° and 150° C., and additional stretching at a temperature between 90° and 100° C., in dry air, in a ratio of 1.2 to 2×.

Depending on the desired use, the yarns thus obtained may be sized, mechanically crimped at a temperature between 20° and 75° C. and cut into fibers having a length of 40 to 150 mm.

They may also be dyed at any stage of the process.

This invention also relates to a process for the production of such yarns and fibers.

The term acrylic yarns and fibers is understood as meaning those produced from polymers containing at least 50% of acrylonitrile units, and preferably at least 85% of acrylonitrile units, and up to 50%, and preferably up to 15%, of units derived from one or more ethylenic monomers which can be copolymerized with acrylonitrile, such as vinyl compounds, for example vinyl chloride and vinyl acetate; acrylic or methacrylic acids, esters and amides; methacrylonitrile; compounds having a carboxylic acid group, such as itaconic acid; or compounds having a sulphonic acid group, such as vinylsulphonic compounds, allyl- and methallyl-sulphonic acids, and sulphonated aromatic derivatives, for example styrene-sulphonic and vinyloxyarenesulphonic acids; vinyl derivatives of the basic type, such as vinylpyridine and its alkylated derivatives, vinyl dialkylamine ethers and the like.

The present invention also applies to mixtures, in varying proportions, of the acrylic polymers listed above.

It is also possible simultaneously to use two solutions of acrylic polymers as defined above, which polymers differ from one another in the nature and amount of the comonomers or in their content of acid or basic equivalents, in order to produce two-component yarns.

The solvents which may be used include all the solvents which are usually employed for spinning acrylic compounds, namely organic solvents, such as dimethylformamide, dimethylacetamide, dimethylsulphoxide or the like, or also inorganic solvents, by themselves or in aqueous solutions, such as nitric acid or alkali metal or alkaline earth metal thiocyanates, chlorides or bromides.

The actual spinning is carried out wet, in the usual manner, into a coagulating bath generally consisting of water and solvent. In the case of organic solvents, the coagulating bath preferably contains 40 to 60% by weight of this solvent.

The filaments are taken up on rollers and stretched in air, at ambient temperature, in a ratio between 1.3 and 3× and preferably 2 and 2.5×, then washed with water, generally in countercurrent and at ambient temperature, and then stretched again in boiling water in a ratio between 1 and 2.5× and preferably between 1.05 and 1.8×. In general, so that the resulting yarns and fibers will possess good textile characteristics, if the stretching in air is carried out in a ratio which is equal or approximately equal to the minimum possible ratio, the stretching in boiling water is preferably carried out in a ratio which is greater than the minimum ratio of 1; conversely, if the stretching ratio in boiling water is 1 or approximately 1, the stretching ratio in air will preferably be chosen far from its minimum value.

After sizing, the cable is dried at a temperature between 80° and 140° C. The drying may be carried out in accordance with any known process, for example by passage over heated calenders or rollers, under a controlled tension which is between zero tension and a tension capable of substantially preventing any shrinkage (that is to say, keeping the yarn at constant length), optionally in the presence of moisture. The process is preferably carried out in a suitable drier, in the relaxed state and in a medium of moist air, at a dry temperature between 80° and 140° C. and at a wet temperature between 50° and 70° C. The duration of the drying obviously depends on the size of the yarn or cable treated and the size of the apparatus used. It may be carried out very rapidly in the course of 1 minute or it may require a duration of 30 minutes, depending on the conditions of treatment. When drying in the relaxed state, the filaments shrink by about 10 to 25%.

The steam treatment is carried out at a temperature between 105° and 150° C. under a tension which is between zero tension, that is to say in the relaxed state, and a tension capable of totally preventing the yarn from shrinking. In general, the process is preferably carried out in the relaxed state, the filamments then undergoing shrinkage, at a temperature between 130° and 145° C.

The duration of the treatment may vary according to the apparatus used and the temperature conditions. For example, it may be as short as 5 seconds or it may range up to 30 minutes. Preferably, for practical reasons it will not exceed 15 minutes.

After additional stretching, at a temperature between 90° and 100° C., for example by means of heated plates or rollers, in a ratio between 1.2 and 2×, and preferably between 1.6 and 1.9×, and after sizing, the yarns may be mechanically crimped at a temperature between 20° and 75° C., and preferably between 65° and 75° C., and then cut into fibers, generally having a length of 40 to 150 mm, depending on the desired use.

In order to obtain the highest shrinkage values (40% or above), the conditions of treatment must be within the preferred ranges indicated above.

In order to produce high-shrinkage yarns or fibers which are directly dyed, it is possible to carry out a dyeing operation during the process for the production of the high-shrinkage yarns and fibers according to the present application, by any conventional means, for example by spun dyeing, that is to say by adding the colorant directly to the spinning solution, by the process for dyeing yarns in the primary swelling stage, as described in French Pat. No. 2,076,516, or in accordance with any other process for dyeing during the process for manufacturing the filaments.

The fibers thus obtained can be carded easily, without it being necessary to mix them with other fibers.

The high-shrinkage yarns and fibers according to the present invention are suitable for mixing, in varying proportions, with other yarns and fibers which can shrink only slightly, if at all, in order to produce bulky spun yarns which may be subjected to further treatments for imparting a certain elasticity thereto. In the case of undyed yarns or fibers, the shrinkage heat treatment can be carried out during a subsequent dyeing operation.

The spun fibers thus obtained are widely used in the textile field, namely in drapery, and weaving, and in particular in fancy velours, plushes, and the like.

The following examples are given, in which the parts are to be understood as being by weight, by way of indication and without implying any limitation, in order still better to illustrate the invention:

In the examples, the shrinkage is measured in the following manner:

Measurement of the initial length $L_1$ under a tension of 50 mg/dtex and then of a length $L_2$ under the same tension after treatment for 15 minutes in boiling water and drying for 10 minutes, in the free state, in an oven at 80° C., and then for 60 minutes in the free state. The shrinkage is given by the formula:

$$\frac{L_1 - L_2}{L_1} \times 100$$

EXAMPLE 1

A 24.3% strength solution, in dimethylformamide containing 5% by weight of water, of a copolymer consisting of:

| | |
|---|---|
| acrylonitrile | 91.5% by weight |
| methyl methacrylate | 7.75 by weight |
| sodium methallylsulphonate | 0.8 by weight |

which copolymer contains 75 milliequivalents of acid/kg of polymer and has a specific viscosity of 0.310 (measured on a 0.2% strength solution in dimethylformamide at 20° C.), is spun into a coagulating bath, kept at 20° C., containing 57% of dimethylformamide and 43% of water.

The filaments are taken up at a speed of 13.18 m/minute, then stretched continuously in air, at ambient temperature, in a ratio of 2.2× at a speed of 29 m/minute, washed in a counter-current of water at ambient temperature, stretched by 1.15× in boiling water at a speed of 33.35 m/minute, sized, and then dried continuously in the relaxed state in a zone at a dry temperature of 110° C. and a wet temperature of 60° C. for 15 minutes. During drying, the filaments shrink by about 17 to 20%.

The cable of filaments is then subjected to a discontinuous steam treatment at 135° C., for 5 minutes, during which it shrinks further (by 7–8%).

It is then subjected to additional stretching in a ratio of 1.6× on plates kept at 130° C., the cable itself being heated to a temperature of 95°–100° C.

It is subsequently sized continuously by spraying with 0.3% of size, then cold-crimped after pneumatic opening, and finally cut into fibers having a length of 110 mm.

The shrinkage force was measured on the cable obtained after crimping, on the one hand on non-shrunk fiber and on the other hand on fiber which had shrunk by 15%.

| | Non-crimped | Crimped |
|---|---|---|
| Shrinkage in boiling water, % | 40.7–42.7 | 40.6–42.1 |
| Shrinkage force in boiling water, mg/tex | | |
| on non-shrunk fiber | 985 | 860 |
| on fiber shrunk by 15% | 426 | 474 |
| Gauge per strand in dtex | 4.5 | 4.7 |
| Tensile strength in g/tex | 19.4 | 16.4 |
| Elongation, % | 19.3 | 15.6 |

EXAMPLES 2 TO 5

Four solutions of an acrylic polymer identical to that of Example 1 are spun in the manner indicated in Example 1, and the yarns are then treated under the following conditions:

| | Example 2 | Example 3 | Example 4 | Example 5 |
|---|---|---|---|---|
| Stretching in air, ratio | 2.2 X | 2.2 X | 2.2 X | 2.2 X |
| Washing in counter-current of water | yes | yes | yes | yes |
| Stretching in boiling water, ratio | 1.05 X | 1.05 X | 1.8 X | 2.5 X |
| Sizing | yes | yes | yes | yes |
| Drying: dry temperature | 110° C. | 110° C. | 110° C. | 110° C. |
| wet temperature | 60° C. | 60° C. | 60° C. | 60° C. |
| Steam treatment: temperature | 105° C. | 145° C. | 145° C. | 145° C. |
| time | 5 min. | 5 min. | 5 min. | 5 min. |
| Additional stretching at 130° C. ratio | 1.3 X | 2 X | 2 X | 1.3 X |

The resulting filaments possess the following characteristics:

| | Example 2 | Example 3 | Example 4 | Example 5 |
|---|---|---|---|---|
| Shrinkage in boiling water, % | 23.1 | 45.9 | 40.3 | 34.5 |
| Shrinkage force in boiling water, mg/tex | | | | |

-continued

| | Example 2 | Example 3 | Example 4 | Example 5 |
|---|---|---|---|---|
| on non-shrunk fiber | 673 | 861 | 1215 | — |
| on fiber shrunk by 15% | 278 | 396 | 253 | — |
| Gauge per strand in dtex | 4.8 | 4.1 | 5.9 | 5.3 |
| Tensile strength in g/tex | 17.6 | 22.9 | 30 | 37 |
| Elongation, % | 24.8 | 15.7 | 14 | 14 |

EXAMPLES 6 AND 7

A 21% strength solution, in dimethylformamide, of a polymer consisting of:

| | |
|---|---|
| acrylonitrile | 99.2% by weight |
| sodium methallylsulphonate | 0.8% by weight |

which polymer contains 83 milliequivalents of acid/kg of polymer and has a specific viscosity of 0.300 (measured on a solution containing 0.2% of polymer in dimethylformamide at 20° C.), and a 24.3% strength solution, in dimethylformamide (containing 5% by weight of water relative to the polymer), of a copolymer consisting of:

| | |
|---|---|
| acrylonitrile | 91.5% by weight |
| methyl methacrylate | 7.7% by weight |
| sodium methallylsulphonate | 0.8% by weight |

which copolymer contains 82 milliequivalents of acid/kg of polyer and has a specific viscosity of 0.325 (measured as indicated above), are prepared separately.

After passing through a static mixer, the two solutions are simultaneously spun, in identical proportions, into a coagulating bath identical to that of Example 1, and the resulting filaments are treated in the following manner:

| | Example 6 | Example 7 |
|---|---|---|
| Stretching in air, ratio | 2.2 X | 2.2 X |
| Washing in countercurrent of water | yes | yes |
| Stretching in boiling water, ratio | 1.15 X | 1.15 X |
| Sizing | yes | yes |
| Drying: dry temperature | 110° C. | 110° C. |
| wet temperature | 60° C. | 60° C. |
| Steam treatment, temperature °C. | 135 | 105 |
| Additional stretching, ratio | 1.7 X | 2 X |

The yarns thus obtained possess the following characteristics:

| | Example 6 | Example 7 |
|---|---|---|
| Shrinkage in boiling water, % | 44.3 | 30.4 |
| Shrinkage force in boiling water, mg/tex | | |
| on non-shrunk fiber | 761 | — |
| on fiber shrunk by 15% | 442 | — |
| Gauge per strand in dtex | 5.2 | 4.5 |

The above shrinkage figures do not take into account the shrinkage due to the inherent crimp of two-component yarns.

EXAMPLES 8 AND 9

A 28% strength solution, in dimethylformamide, of a polymer consisting of

| | |
|---|---|
| acrylonitrile | 59.3 parts by weight |
| vinylidene chloride | 36.2 parts by weight |
| acrylamide | 2 parts by weight |
| sodium methallylsulphonate | 2.5 parts by weight |

which polymer contains 84 milliequivalents of acid/kg of polymer and has a specific viscosity of 0.300, is prepared.

This solution is spun into a coagulating bath, kept at 53° C., containing 53% of dimethylformamide and 47% of water. The yarns issuing from the spinneret are subjected to the following treatments:

| | |
|---|---|
| Stretching in air, ratio | 2.2 X |
| Washing in countercurrent of cold water | yes |
| Stretching in boiling water, ratio | 1.15 X |
| Sizing | yes |
| Drying: wet temperature | 60° C. |
| dry temperature | 115° C. |
| Steam treatment | Example 8: 115° C.<br>Example 9: 130° C. |
| Additional stretching, ratio | 1.7 X |

Characteristics of the resulting yarns:

| | Example 8 | Example 9 |
|---|---|---|
| Gauge per strand in dtex | 5 | 5 |
| Shrinkage in boiling water, % | 40 | 43 |

EXAMPLE 10

A 20% strength solution, in dimethylsulphoxide, of a copolymer consisting of:

| | |
|---|---|
| acrylonitrile | 91.4% by weight |
| methyl methacrylate | 7.75% by weight |
| sodium methallylsulphonate | 0.85% by weight |

which copolymer contains 75 milliequivalents of acid/kg of polymer and has a specific viscosity of 0.32 (measured on a 0.2% strength solution in dimethylformamide) is spun into a coagulating bath, kept at 20° C., containing 50% of water and 50% of dimethylsulphoxide, through a spinneret possessing 200 orifices of 0.055 mm diameter.

The filaments are taken up at a speed of 10.7 m/minute, then stretched in air, at ambient temperature, in a ratio of 2× at a speed of 21.4 m/minute, washed in a countercurrent of water at ambient temperature, stretched in boiling water in a ratio of 1.102× at a speed of 23.6 m/minute, sized, and then dried, under a tension which keeps the yarns at constant length, on rollers kept at 110° for 65 seconds.

The filaments are subsequently subjected to a steam treatment, under tension, at a temperature of 105° to 140° C. for 20 minutes, and are then subjected to additional stretching in a ratio of 1.6× on a heated plate kept at 125° C.

The yarns thus obtained possess the following characteristics:

| | |
|---|---|
| Gauge | 2.5 dtex |
| Tensile strength | 22.9 g/tex |

-continued

| | |
|---|---|
| Elongation | 14.4% |
| Modulus of elasticity | 763 g/tex |
| Shrinkage in boiling water | 32 to 38% |

EXAMPLE 11

The same copolymer as in Example 10 is spun under conditions identical to those indicated in Example 10 as regards the spinning, the stretching operations in air and boiling water, the washing, and the drying. On the other hand, the vaporization is carried out under zero tension for 20 minutes at a temperature varying between 105° and 140° C. The filaments are then subjected to additional stretching in a ratio of 1.6× on a heated plate kept at 125° C.

The resulting filaments possess the following characteristics:

| | |
|---|---|
| Gauge | 2.57 dtex |
| Tensile strength | 22.8 g/tex |
| Elongation | 16.45% |
| Modulus of elasticity | 714 g/tex |
| Shrinkage in boiling water | 34 to 40% |

What is claimed is:

1. A process for the production of acrylic yarns and fibers having a latent shrinkage of up to 50% in boiling water, characterized in wet spinning at least one solution of acrylic polymer, stretching the resulting filaments in air, at ambient temperature, in a ratio between 2 and 2.5×, washing with water, stretching in boiling water in a ratio between 1.05 and 1.8×, sizing, drying in the relaxed state in a zone kept at a dry temperature between 80° and 140° C. and a wet temperature between 50° and 70° C. for 1 to 30 minutes, steam treating in the relaxed state at a temperature between 105° and 150° C. for 5 seconds to 30 minutes, additionally stretching at a temperature between 90° and 100° C. in a ratio of 1.2 to 2×, sizing, mechanically crimping at a temperature between 20° and 75° C., and cutting into fibers.

2. A process for the production of acrylic yarns and fibers having a latent shrinkage of up to 50% in boiling water according to claim 1, characterized in that they are also dyed during their preparation.

3. A process for the production of acrylic yarns and fibers having a latent shrinkage of up to 50% in boiling water, characterized in that it comprises the following steps:

wet-spinning at least one solution of acrylic polymer and stretching the resulting filaments in air, at ambient temperature, in a ratio between 1.3 and 3×;
washing with water;
stretching in boiling water in a ratio between 1 and 2.5×;
sizing;
drying at a temperature between 80° and 140° C.;
vapor-treating at a temperature between 105° and 150° C.; and
additionally stretching at a temperature between 90° and 100° C. in a ratio of 1.2 to 2×.

4. A process for the production of acrylic yarns and fibers having a latent shrinkage of up to 50% in boiling water according to claim 3, characterized in that they are also dyed during their preparation.

5. A process for the production of acrylic fibers having a latent shrinkage of up to 50% in boiling water, characterized in that it comprises the following steps:

wet-spinning at least one solution of acrylic polymer into a coagulating bath containing 40 to 60% of water and 60 to 40% or organic solvent;
stretching in air, at ambient temperature, in a ratio between 2 and 2.5×;
washing in a countercurrent of water;
stretching in boiling water in a ratio between 1.05 and 1.8×;
sizing;
drying in the relaxed state in a zone kept at a wet temperature between 50° and 70° C. and a dry temperature between 80° and 140° C. for 1 to 30 minutes;
steam treating in the relaxed state at a temperature between 105° and 150° C. for 5 seconds to 30 minutes;
additionally stretching at a temperature between 90° and 100° C. in a ratio between 1.6 and 1.9×;
sizing;
mechanically crimping at a temperature between 65° and 75° C.; and
cutting into fibers having a length of 40 to 150 mm.

* * * * *